US005323697A

United States Patent [19]

Schröck

[11] Patent Number: 5,323,697

[45] Date of Patent: Jun. 28, 1994

[54] RADIAL PRESS HAVING TWO PRESS YOKES MOVABLE RADIALLY AGAINST ONE ANOTHER

[76] Inventor: Peter Schröck, Schlierbacherweg 17, D-6117 Schaafheim, Fed. Rep. of Germany

[21] Appl. No.: 958,915

[22] Filed: Oct. 9, 1992

[30] Foreign Application Priority Data

Oct. 28, 1991 [DE] Fed. Rep. of Germany ..... 4135465

[51] Int. Cl.[5] ..... B30B 7/04

[52] U.S. Cl. ..... 100/232; 29/237; 72/402; 100/269 R; 100/291; 425/330

[58] Field of Search ..... 100/214, 232, 269 R, 100/291, 53; 29/237; 72/402, 453.12; 425/77, 330

[56] References Cited

U.S. PATENT DOCUMENTS

| | | | |
|---|---|---|---|
| 1,782,219 | 11/1930 | Wallace | 29/237 |
| 2,072,694 | 3/1937 | Walter | 100/232 |
| 3,146,697 | 9/1964 | Dohm, Jr. et al. | 100/232 X |
| 3,229,621 | 1/1966 | Decker et al. | 100/232 X |
| 3,327,622 | 6/1967 | Lebovitz | 100/232 X |
| 3,669,605 | 6/1972 | Reilly | 100/53 X |
| 3,762,209 | 10/1973 | Herndon et al. | 72/402 |
| 3,797,986 | 3/1974 | Onder | 425/330 X |
| 4,123,929 | 11/1978 | Huydts . | |
| 4,766,808 | 8/1988 | Schrick | 100/232 |
| 4,785,656 | 11/1988 | Kennedy | 29/237 X |
| 4,854,031 | 8/1989 | Eisenzimmer | 29/237 X |

FOREIGN PATENT DOCUMENTS

| | | | |
|---|---|---|---|
| 719097 | 3/1942 | Fed. Rep. of Germany . | |
| 1905349 | 9/1964 | Fed. Rep. of Germany . | |
| 2707993 | 8/1977 | Fed. Rep. of Germany . | |
| 2625482 | 12/1977 | Fed. Rep. of Germany . | |
| 3513129 | 10/1986 | Fed. Rep. of Germany . | |
| 3611253 | 10/1987 | Fed. Rep. of Germany . | |
| 2341093 | 9/1977 | France | 100/232 |

OTHER PUBLICATIONS

Finn-Power leaflet: Digital Microprocessor Control With A Memory For 12 Settings, Admitted Prior Art, No Date.

*Primary Examiner*—Stephen F. Gerrity
*Attorney, Agent, or Firm*—Felfe & Lynch

[57] ABSTRACT

In a radial press having a press axis (A), a plurality of outer cam surfaces (1, 2, 3, 4) at an angle to one another are grouped in two press yokes (18, 19) which are driven radially against one another. The planes of symmetry of the cam surfaces (1-2 and 3-4) disposed in the same press yoke are parallel with the drive direction. A number of outer cam follower bodies (31) lying between each pair of the outer cam surfaces serve for the radial advancement of press jaws (30) toward the press axis. Inner cam follower bodies (37) with additional press jaws (41) are driven synchronously by the outer cam follower bodies (31). To reduce weight and size the one press yoke (18) is guided with respect to the other press yoke (19) by traction posts (25, 26) which pass through the guiding press yoke (19) at its extremities lying outside of the cam surfaces (1, 2, 3, 4), are fixedly joined to the other, guided, press yoke (18), and are joined on the other side of the guiding press yoke to a traction-producing drive (52) which is preferably in the form of a hydraulic jack (47/51, 48/50) associated with each traction post.

10 Claims, 6 Drawing Sheets

RADIAL PRESS HAVING TWO PRESS YOKES MOVABLE RADIALLY AGAINST ONE ANOTHER

BACKGROUND OF THE INVENTION

The invention relates to a radial press with a press axis and with a plurality of outer cam surfaces which are disposed at an angle to one another and have surface normals aimed at the press axis, and which are disposed in sets of two press yokes movable radially against one another by a driving system, the planes of symmetry of the cam surfaces disposed in the same press yoke running parallel to the drive direction, and having several outer cam follower bodies, each lying between two of the outer cam surfaces, for the radial advancement of press jaws toward the press axis.

Such radial presses serve for the shaping or machining of workpieces having rotationally symmetrical external surfaces, such as pipes, tubes, thimbles etc. An especially wide field of application of such radial presses is the manufacture of hoses by the radial pressing of hollow cylindrical hose sleeves, provided as a rule with an internal bead, onto a hose end having an armature of steel wire, from which the elastomeric outer layer has been removed. In the end of the hose in this case is a coupling piece consisting of metal, against which the hose end is to be pressed under high pressure by means of the sleeve. Such hose lines must be able to withstand pressures of up to 1,000 bar and more under fluctuating stress over a long period of time. Any failure of such a hose with a discharge of hydraulic fluid can lead to fatal injuries, and therefore the radial presses in question must satisfy stringent requirements.

The term, "rotationally symmetrical outside surfaces", is to be understood to mean workpiece shapes with circular cross sections and cross sections in the form of regular polygons, such as those to be found in hexagonal cross sections. The outer surfaces of the workpiece can be straight, barrel-shaped or stepped. Such workpiece surfaces can be provided for by shaping the press jaws accordingly.

Another problem is based on the fact that neither the press manufacturer nor the user can anticipate the numerous shapes of metal couplings for the hoses in question. A large number of the couplings are in the form of elbows, for example, and coupling parts with long tubular pieces are known. Such coupling units necessitate a great amount of free space on the back of the press facing away from the operator's side, and likewise a very short axial depth in the press. Both requirements militate against the design needs of such presses, in which high pressing forces and reaction forces must be reckoned with. Furthermore, the presses in question must be as small as possible and for many applications they must also be transportable without great complications, for example for use on large construction sites. Special machines have, as a rule, a large number of high-pressure hose lines which also have to be replaced and repaired in the field, by separating the hose from the still usable coupling parts. The re-use of the coupling parts is practiced even for the sake of reducing industrial waste.

A radial press of the kind described above pertains to the state of the art due to public use, and its principles of design and action will be further explained in a detailed description in conjunction with FIG. 1. At this point it will only be said that the press in question has a large and heavy one-piece press frame completely encompassing the hydraulic cylinder for reasons of strength.

German patent disclosure document OS 35 13 129 discloses a radial press with four hydraulic drivers disposed star-wise, in which twice the number of press jaws, namely eight, can be actuated synchronously by the interaction of four outer and four inner cam follower bodies. This press too has a large and heavy press frame, which is ring-like.

It is the object of the invention, on the other hand, to provide a radial press of the kind described above, which will be smaller and lighter, have an extremely short depth, and on the back of the press facing away from the operator's side, it will have virtually unlimited room both for the insertion of fittings with elbows and for the processing of fittings with long pipes and of endless tubing.

The solution of the problem is accomplished in accordance with the invention in the radial press described above in that the one press yoke is moved against the other press yoke by traction posts which are disposed parallel to the direction of action and pass through the guiding press yoke at the ends of the yoke outside of the yoke's cam faces, are affixed to the other, guided press yoke, and are connected on the other side of the guiding press yoke to a driver having a pulling action.

A radial press thus configured combines an extremely small size and especially small depth with low weight and an extremely simple construction.

The drivers with pulling action might be, for example, threaded spindles; it is especially advantageous, however, if a hydraulic jack could be associated with each traction post. Since the radial press does not require a circular press frame as in the state of the art, there is no need for components subject to traction and/or flexure to be mounted around the hydraulic jack, so that substantially larger piston faces can be used without interfering with a press frame, so that either the pressing force can be increased or the driving capacity of the hydraulic jack can be reduced. Further particulars on this will be set forth in the detailed description.

An especially advantageous design of such a press is characterized, pursuant to additional development, in that the press axis is horizontal, that the bottom, guiding press yoke is disposed on a platform beneath which the hydraulic jacks are in a case containing hydraulic fluid, and that the bottom press yoke and the hydraulic jacks are mounted on opposite sides of the platform.

In such a design the positive forces and reaction forces are directly engaged with one another and cancel one another within a minimum of space. Therefore it is not even necessary to provide the platform with any special rigidity.

The term, "platform," as used herein refers to all components which absorb the contrary forces of the press yoke and the hydraulic jack. In the simplest case it can be a horizontal steel plate serving as the cover or top of the case.

It is especially advantageous that each press yoke has an approximately parallelepipedal envelope surface with one long axis and two cam faces set at a right angle to one another and separated by a planar surface parallel to the long axis of the parallelepiped, the bisectors of the angle being parallel to the direction of the press action; that four outer cam follower bodies and four inner cam follower bodies are present, which alternate on the circumference; that the outer cam follower bodies lying above and below the press axis are supported motionless on the said planar surfaces of the press yokes; that the press yokes have additional planar boundary surfaces radially outside of the cam faces, which are parallel to one another and perpendicular to the direction of the press action, and that the bores in line with one another in pairs that are provided for two traction posts are brought through these planar boundary surfaces.

Additional advantageous configurations of the subject matter of the invention will be found in the secondary claims.

SUMMARY OF THE INVENTION

In accordance with the invention, a radial press comprises a set of movable press yokes (18, 19), a press axis (A) and a plurality of outer cam surfaces (1, 2, 3, 4) which are disposed at an angle to one another and have surface normals aimed at the press axis, and which are disposed in the set of movable press yokes (18, 19), a driving system for moving the set of two press yokes in a drive direction (17) radially against one another, cam surfaces (1-2, and 3-4, respectively) disposed in the same press yoke having planes of symmetry running parallel to the drive direction, several outer cam follower bodies (31, 32, 33, 34), each lying between two of the outer cam surfaces, for the radial advancement of press jaws (30, 41) toward the press axis, traction posts (25, 26) for guiding one guided press yoke (18) with respect to the other guiding press yoke (19), the traction posts running parallel to the drive direction and passing through the guiding press yoke (19) on a side at its ends lying outside of the cam surfaces (1, 2, 3, 4), and fixedly joined to the other, guided, press yoke (18), and joined on an other side of the guiding press yoke to a driver having a pulling action (52)..

BRIEF DESCRIPTION OF THE DRAWING

The state of the art, as well as an embodiment of the subject matter of the invention, will be further explained with the aid of FIGS. 1 to 7.

In FIG. 1 there is shown a radial press according to the state of the art, wherein four cam faces 1, 2, 3 and 4 are in pairs at right angles to one another. The cam faces 1 and 2 are disposed in the upper yoke 5 of a press frame 6 that is continuous all around and which also surrounds a double-acting hydraulic cylinder 7 with a piston 8. A very thick piston rod 9 designed for pressure connects the hydraulic jack 10 to a bottom yoke 11 in which the cam faces 3 and 4 are disposed.

Figure 1:
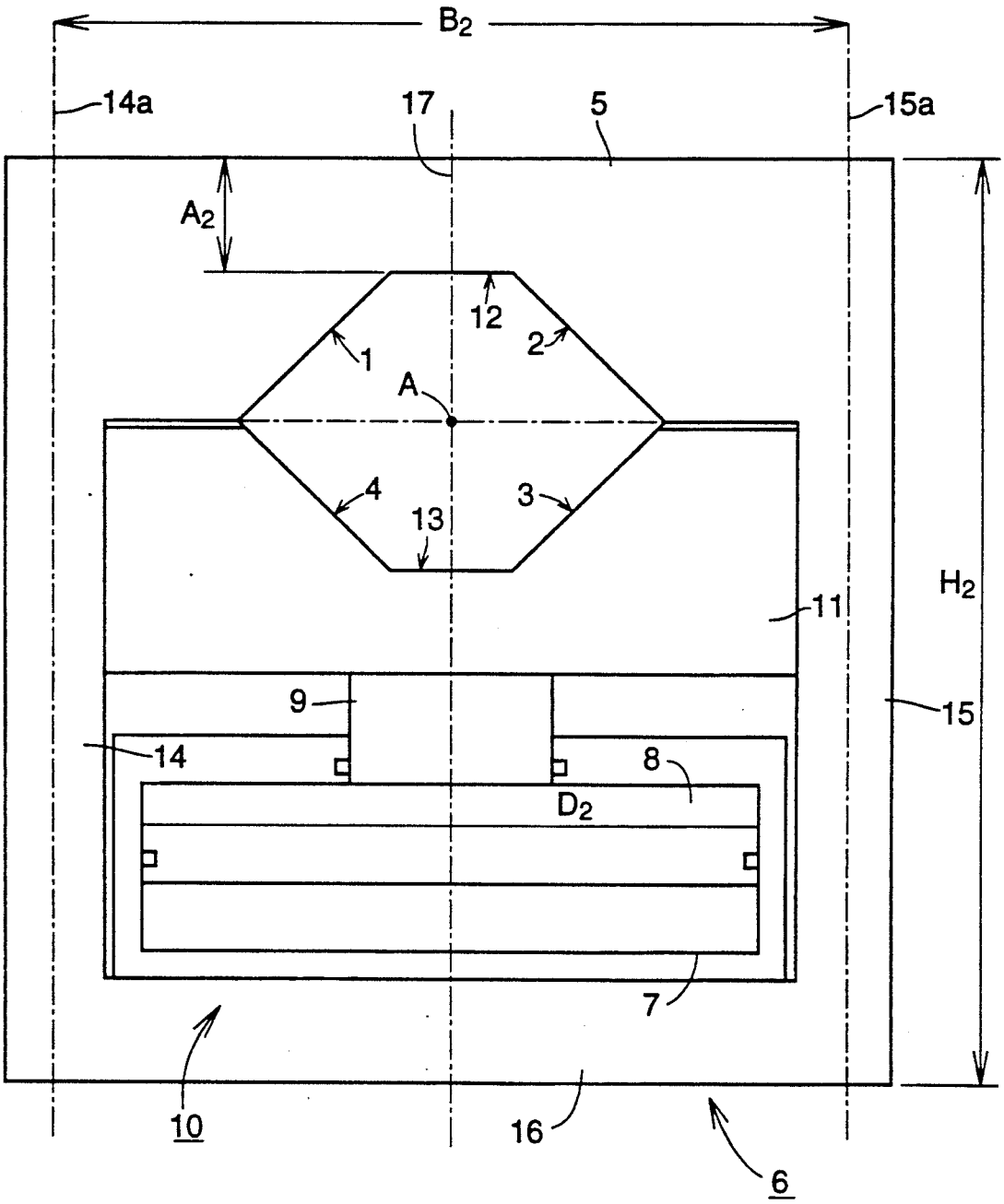
FIG. 1 PRIOR ART
FIG. 1 shows the principle of construction and operation of a radial press according to the generic idea and according to the state of the art, respectively.

The cam faces 1 to 4, as seen in projection onto the plane of drawing, are on the sides of a square. To avoid excessive weakening of the yokes 5 and 11, however, two corners of this square are set back, so that the pair of cam faces 3 and 4 are separated by an additional planar surface 13. Thus a bridging portion of the thickness $A_2$ is formed in the upper yoke 5. The bridging portion of the bottom yoke 11 is not further identified. The bridging portion $A_2$, however, must nevertheless be of adequate thickness, because in the center of the yoke 5 great flexural moments occur, which are due to the great distance $B_2$ between the center lines 14*a* and 15*a* of the sides 14 and 15 of the press frame 6. Overall, the press frame 6 has a considerable height $H_2$ which is due to the design of the cam faces 1 to 4, the hydraulic drive 10 and the necessary thicknesses in the upper yoke 5, in the bottom yoke 11, and in the base yoke 16 of the press frame. It is obvious that such a press frame is large and heavy, and means must additionally be provided for guiding the bottom yoke 11 in the press frame 6, which are not shown here for the sake of simplicity. The rest of the hydraulic units for supplying the hydraulic jack 10 must be housed outside of the press frame 6, which again are not shown here for the sake of simplicity.

Here let it be explained once again that the press axis A is perpendicular to the plane of drawing, and that the direction of drive is indicated by the broken line 17 which passes through the axis of the piston rod 9. The bisectors of the angles of the cam faces 1 and 2 and of the cam faces 3 and 4 run in the direction of line 17 through the press axis A.

DESCRIPTION OF THE PREFERRED EMBODIMENT

Figure 2:
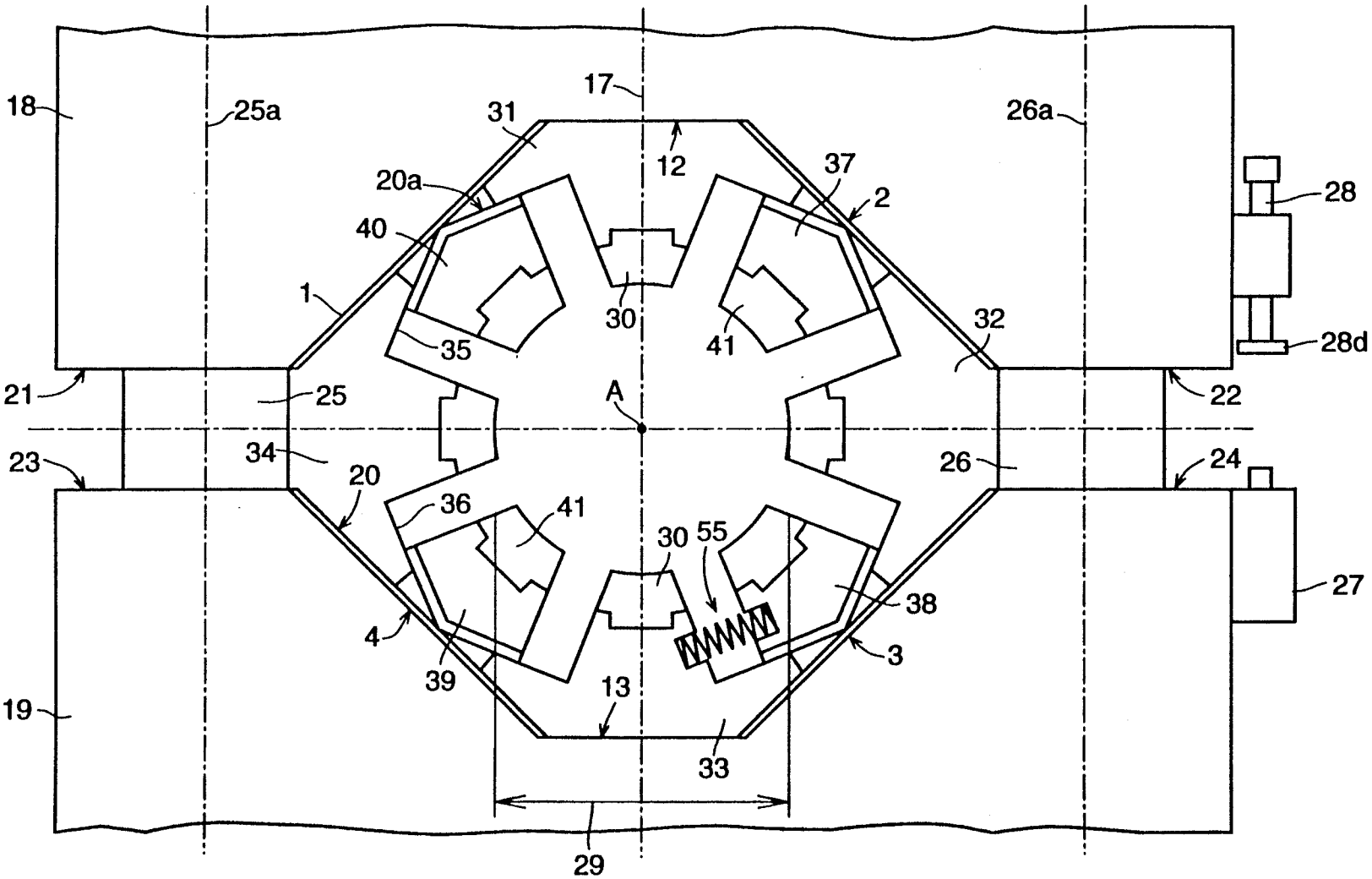
FIG. 2 shows the principle of action of the control surfaces with respect to the individual press jaws.

FIG. 2 shows an upper yoke 18 and a bottom yoke 19 in accordance with the invention. Each of these yokes has an approximately parallelepipedal envelope surface with a longitudinal axis, not shown here, running perpendicular to the direction of driver 17 and parallel to the plane of drawing. The two press yokes 18 and 19 have the planar cam faces 1 to 4 described above, which in the present case are provided with facings 20 of a permanently lubricating material. The explanations given above apply with regard to the geometrical arrangement of the cam faces and to the separation created between them by the planar surfaces 12 and 13 which are parallel to the long axes of the parallelepiped.

The press yokes 18 an 19 have additional planar boundary surfaces 21, 22, 23 and 24, which are parallel to one another in pairs 21/23 and 22/24, and run perpendicular to the direction of drive 17. The identical spacings between the boundary surfaces 21/23 and 22/24 define a stroke H which the upper press yoke 18 can execute against the bottom, fixed press yoke 19. Between the press yokes 18 and 19 can be seen sections of tension armatures 25 and 26 whose longitudinal axes are indicated by the broken lines 25*a* and 26*a*, respectively. On the bottom yoke 19 there is a microswitch 27 and on the upper yoke 18 an adjusting spindle 28 with a pusher plate 28*a* for the microswitch 27. The arrangement in question forms an adjustable stroke limiter for the total stroke of the press jaws, starting from the maximum possible opening corresponding to the double arrow 29.

Four outer control bodies 31, 32, 33 and 34 are supported against the cam faces 1 to 4 and each has a press jaw 30 in its center. Each of these outer control bodies has in mirror-image symmetry with its axis of symmetry on both sides an inner cam face 35 and 36, and on two adjacent cam faces 35 and 36 of each pair of outer control bodies is an inner cam follower body 37, 38, 39 and 40, each bearing a press jaw 41 of the same configuration as press jaw 30. The inside surfaces of all the press jaws are at the same distance from the press axis A. The outside surfaces of the inner control bodies 37 to 40 which are at an angle of 135 degrees likewise bear a facing 20*a* of a permanently lubricating material. The attitude angle of the individual cam faces to one another is selected so that the inner cam follower body borne by the inner cam faces 35 and 36 can be moved at the same radial speed and over the same radial distance as the outer control bodies 31 and 34.

It can be seen that the outer control bodies 31 and 33 situated directly over and under the press axis A remain stationary on the planar surfaces 12 and 13, while the outer control bodies 32 and 34 between them perform a movement toward the press axis A under the action of the cam faces 1 to 4 when the yokes 18 and 19 come together. During this pressing stroke the press axis A performs a downward movement of the magnitude of one-half of the movement of the upper yoke 18.

It can be seen that the outer and inner control bodies alternate on the circumference. It can also be understood that the bores for the two tension armatures 25 and 26, which are not especially highlighted here, run all the way through the boundary surfaces 21 to 24 of the yokes 18 and 19.

In the figures that follow the same parts as before are identified by the same reference numbers. FIG. 2 shows an enlarged detail of FIG. 3, so that the parts lying within the cam faces 1 to 4 do not have to be discussed again. It can be understood that the upper ends of the tension armatures 25 and 26 bear nuts 42 and 43 resting on the upper press yoke 18. The bottom ends of the tension armatures 25 and 26 pass through a platform 44 consisting of a thin steel plate and simultaneously forming the cover of a case 45 containing a hydraulic fluid 46. While the bottom press yoke 19 is supported on the top of the platform 44, two hydraulic cylinders 47 and 48 are held on the bottom of the platform 44. The bottom ends of the tension armatures 25 and 26 reach into these hydraulic cylinders 47 and 48 through bores 49 of which only one is represented by a radial section through the hydraulic cylinder 48. The bottom ends of the tension armatures 25 and 26 are joined to single-acting pistons 50 and 51, which are represented in FIG. 4.

The hydraulic cylinders 47 and 48 together with the pistons 50 and 51, which are driven on one side only, form a drawing mechanism 52.

The hydraulic cylinders 47 and 48 are situated side by side leaving a small gap in which a tensionally stressed piston rod 53 of a hydraulic jack 54 is located. The upper end of the piston rod 53 is screwed to the bottom yoke 19, while the bottom end bears a piston 54*a* which is encompassed by a hydraulic cylinder 54*b* (especially FIG. 4). The cylinder 54*b* is in contact with the pistons 50 and 51 and, when the annular space above the piston 54*a* is pressurized it forces them upwardly to the position shown in FIG. 3. This movement is followed, through the tension armatures 25 and 26, by the upper press yoke 18, while the bottom press yoke 19 remains on the platform 44. Thus the cam faces and 4, and 2 and 3, respectively, move apart, and the press jaws return under the action of compression springs 55 to their open position, which is indicated by the double arrow 29.

Figure 3:
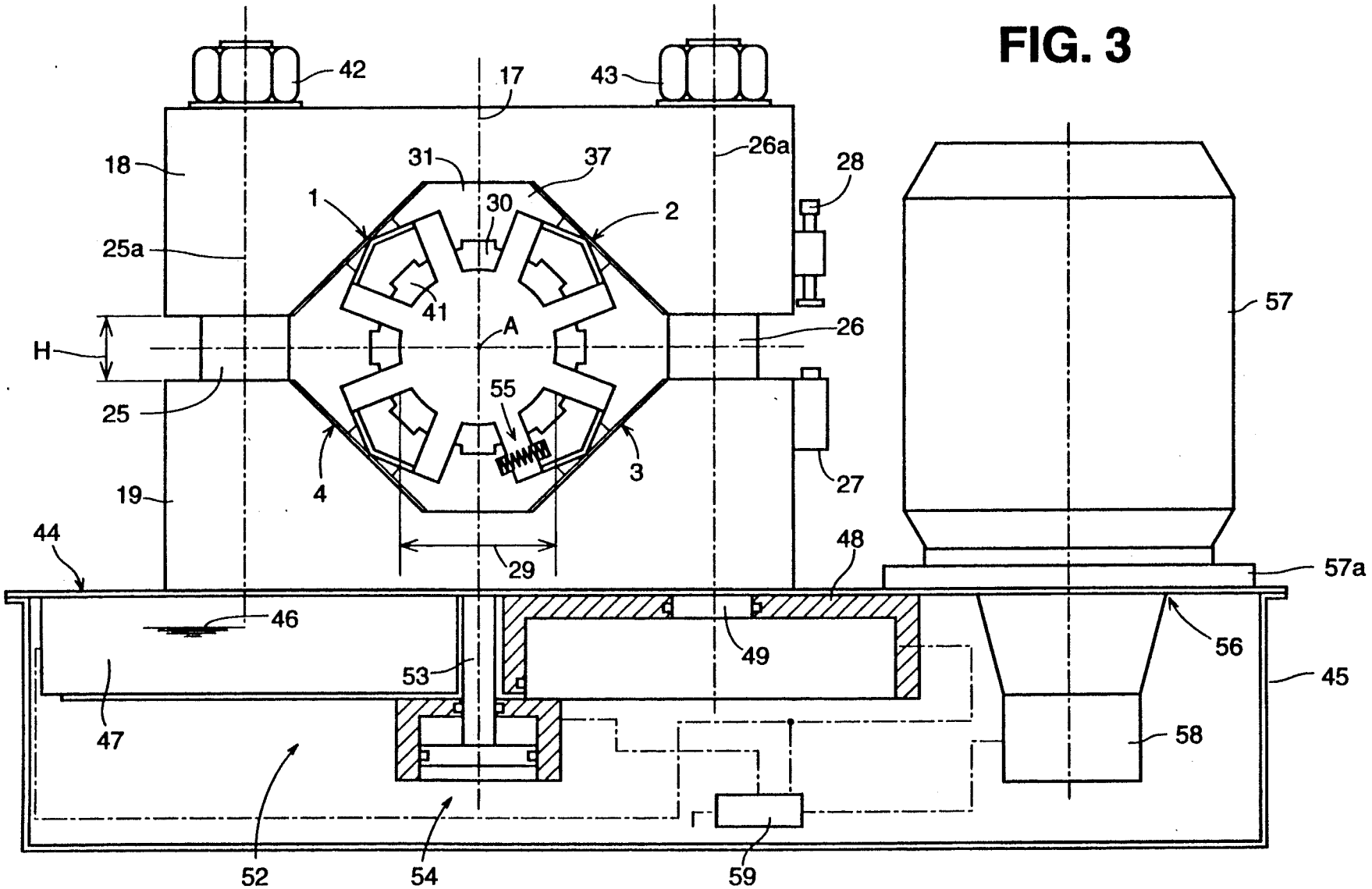
FIG. 3 represents a radial press in accordance with the invention with the details according to FIG. 2, with the press jaws in the open state.
Figure 4:
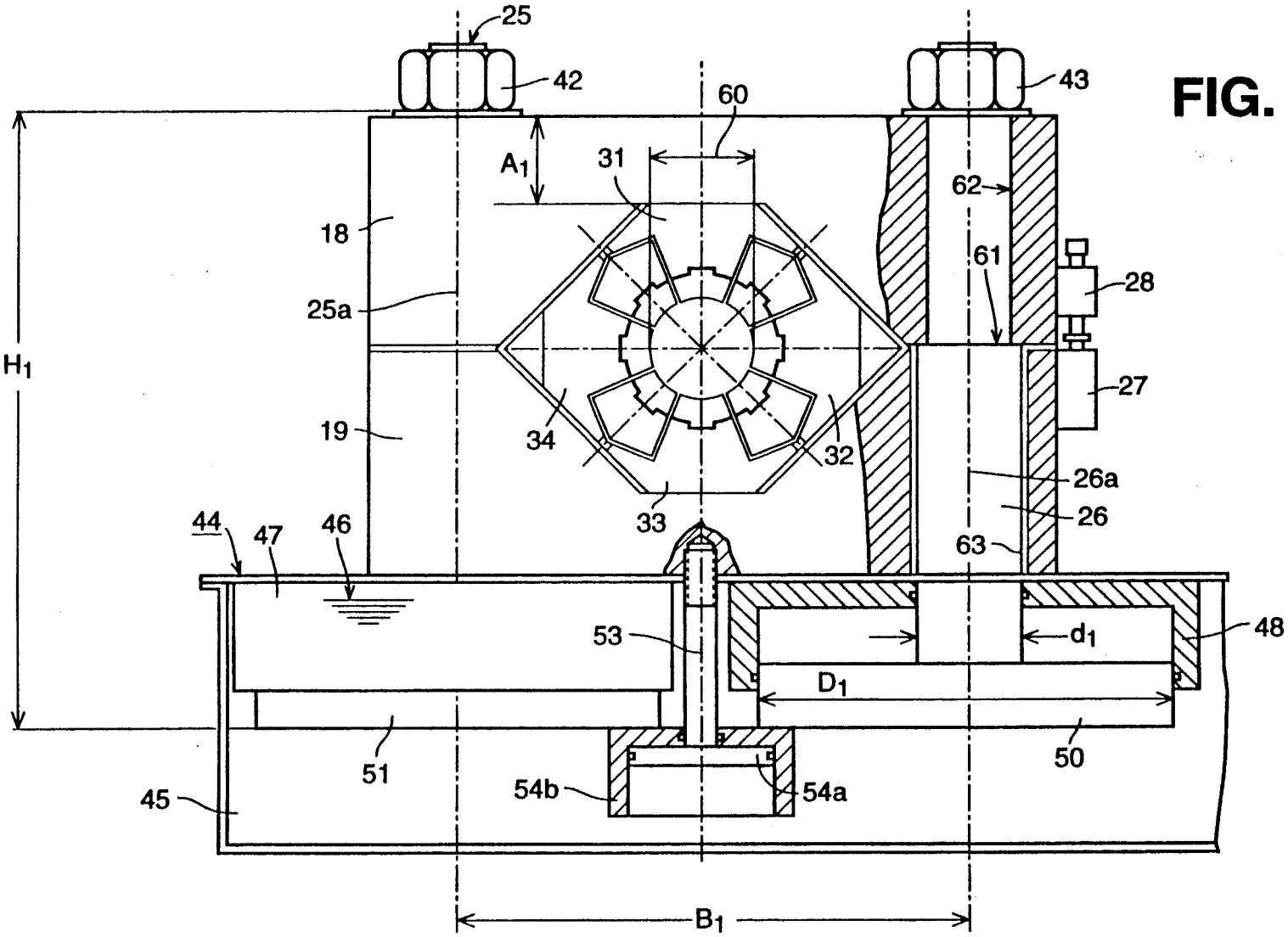
FIG. 4 shows the radial press according to FIG. 3 with the press jaws in the closed state.

In back of the plane of drawing according to FIG. 3, the platform 44 has a circular opening 56 on which a motor 57 is fastened by means of a flange 57*a*. Underneath the recess 56 a hydraulic pump 58, in the form of a submersible pump, is flange-mounted to the motor 57. This pump is connected by a control valve 59 and by hydraulic tubing indicated by broken lines to the individual hydraulic drives. All of the hydraulic drive elements are contained within the case 45, as represented in FIG. 3, so that not only is an extremely simple routing of the lines possible, but also leakage can be disregarded.

FIG. 4 shows the radial press with the press jaws in the closed position. The distances between diametrically opposite press jaws, whose working surfaces in this case make up a cylindrical surface, are at a distance apart (diameter) that is indicated by the double arrow 60. It can also be seen that the upper cam follower body 31 and the bottom cam follower body 33 remain steady on the corresponding planar surfaces 12 and 13, respectively, while the other two control bodies 32 and 34 have been pushed toward the press axis A under the action of the cam faces 1/4 and 2/3, respectively.

It can furthermore be seen that the tension armature 26 has a shoulder 61 which is situated in the seam between the two press yokes. With this shoulder the upper end of reduced diameter of the tension armature 26 is drawn by means of the nut 43 against the upper press yoke 18. Fitted bores 62 serve to accommodate the said reduced ends. The same applies, of course, to the situation of tension armature 25. The larger-diameter section of each of the tension armatures 25 and 26 is held with clearance and with the interposition of a bearing material if desired, in bores 63 of the bottom press yoke 19, as shown on the right side of FIG. 4. Therefore the upper press yoke 18 is the guided part and the bottom press yoke 19 the guiding part.

It can also be learned from FIG. 4 that the distance $B_1$ between the axes 25*a* and 26*a* of the tension armatures is less than the distance $B_2$ between the so-called "neutral axes" of the press frame according to FIG. 1 in the area of the frame opening for the hydraulic driver 10 and the press yoke 11 (FIGS. 1, 3 and 4 are comparable in scale). In this manner it is possible to keep the cross section at the weakest point of the upper press yoke 18, which is characterized by the dimension $A_1$, considerably smaller than is the case in the state of the art according to FIG. 1 with the dimension $A_2$. Also in regard to the total height of the parts essential to the operation of the press, a lower structural height is achieved in the subject matter of the invention with the dimension $H_1$ than in the state of the art with the dimension $H_2$. Lastly, in the subject matter of the invention, a definitely larger piston cross section can be contained underneath the press yokes 18 and 19, because the sum of two piston areas with the diameter $D_1$ is definitely greater, even after deducting the cross-sectional areas for the tension armature, than the cross-sectional area of a single piston with the diameter $D_2$ according to FIG. 1. Lastly, as regards the use of material, the two tension armatures can be configured with a decidedly smaller diameter $d_1$ than is the case in a piston rod under compressive stress in accordance with FIG. 1. Also, a beam on two bearings, as in the subject matter of the invention, is always subjected to much less stress than a beam supported in the center as in the state of the art with the bottom press yoke 11.

Figure 5:
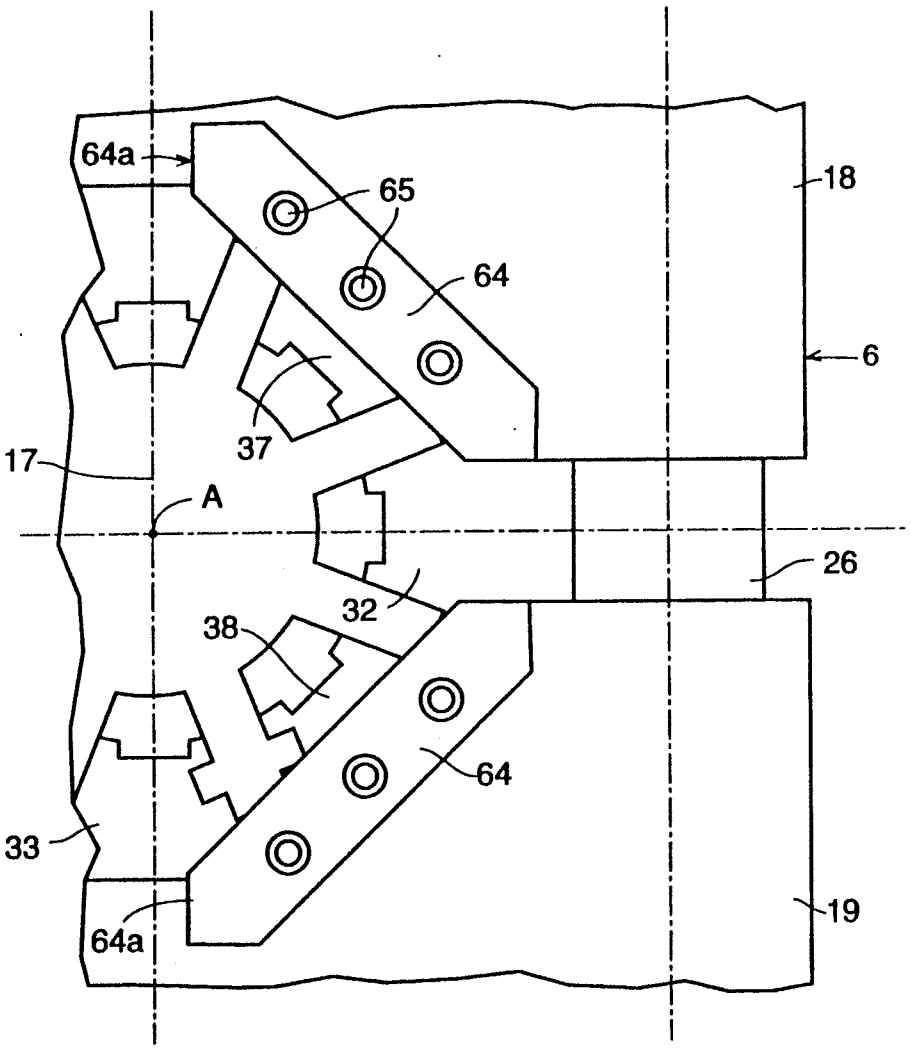
FIG. 5 shows the right half of FIG. 2 with additionally placed guide plates.

In FIG. 5 it is shown that guide bars 64 are fastened releasably by screws 65 in a mirror-image relationship on the plane-parallel side faces of the upper yoke 18 and lower yoke 19, and they contain between them the inner control bodies 37 to 40 and thereby prevent them from slipping out axially. This assumes that the width of the yokes 18 and 19 is wider by the necessary clearance of the control bodies than the axial length of these control bodies. The boundary surfaces 64*a* parallel to the direction of press action 17 do not reach as far as a plane of symmetry passing through the press axis A—A, but instead leave a space between them which facilitates the pressing of armatures with pipe elbows.

Figure 6:
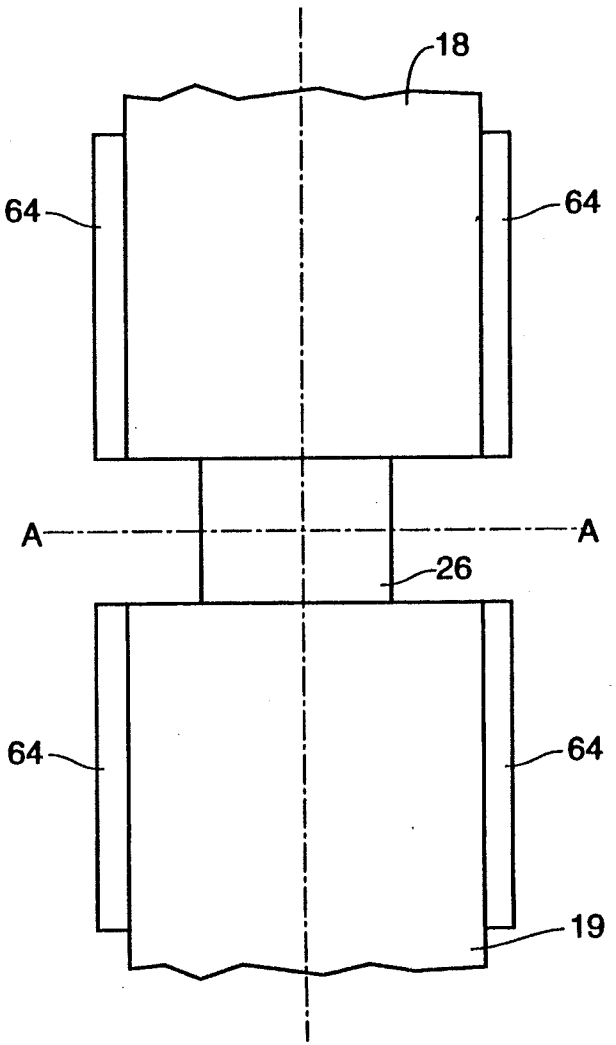
FIG. 6 is a side view of the subject of FIG. 4 seen in the direction of arrow VI in FIG. 5.

FIG. 6 shows the situation in the direction of the arrow VI in FIG. 5.

Figure 7:
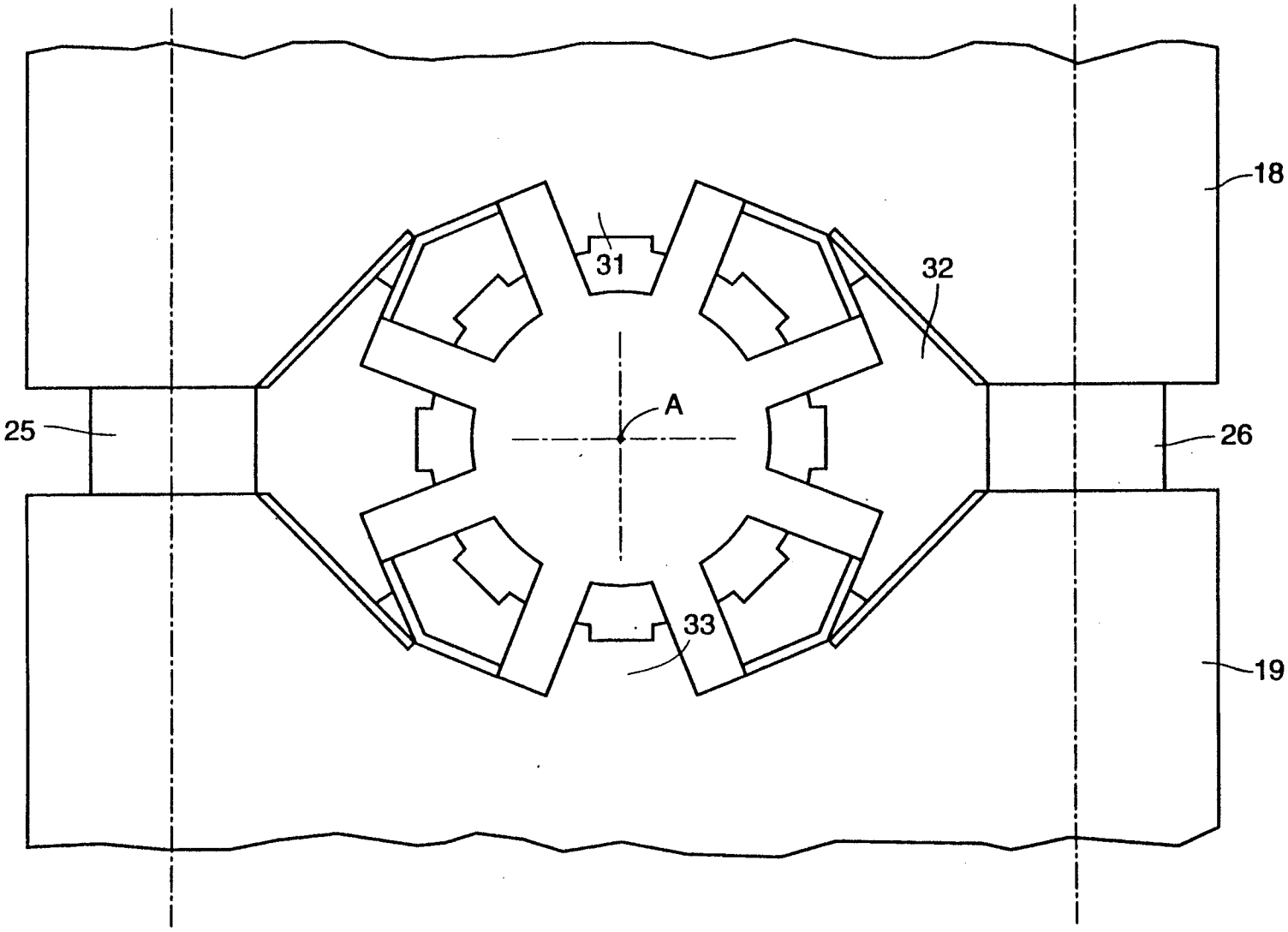
FIG. 7 is a variant of the subject of FIG. 2.

FIG. 7 shows a variant of the subject of FIG. 2. In this case the uppermost cam follower body 31 and the lowermost cam follower body 33 are made integral or in one piece with the press yoke 18 and 19. This makes the formation of the press yokes 18 and 19 more difficult, but the one-piece outer control bodies 31 and 32 serve to increase the moment of resistance of the press yokes 18 and 19. Of course, the subject of FIG. 7 also has the guide bars 64 shown in FIGS. 5 and 6, which are omitted from FIG. 7 for the sake of simplicity.

While there has been described what is at present considered to be the preferred embodiment of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. Radial press comprising: a set of two press yokes with a first yoke being movable toward and away from a second yoke, a press axis (A) and a plurality of outer cam surfaces which have surface normals aimed at the press axis, and at least two of said plurality of outer cam surfaces being capable of actuation by the first movable press yoke, a driving system for moving the first press yoke in a drive direction toward the second yoke with respect to the press axis (A), one pair of the outer cam surfaces being disposed in the first press yoke and a second pair of the outer cam surfaces being disposed in the second press yoke, a plurality of outer cam control bodies, each lying between two of the outer cam surfaces and each having a press jaw, a plurality of inner cam follower bodies each lying between two outer cam control bodies for radial advancement by two of said outer cam control bodies, and each having a press jaw, said outer cam surfaces and said control bodies radially advancing said press jaws toward the press axis, traction posts for guiding the first press yoke with respect to the second press yoke, the traction posts running parallel to the drive direction and passing through the second press yoke at ends of the second press yoke lying beyond the outer cam surfaces with respect to the axis (A), and fixedly joined to the first press yoke, and the driving system including a driver having a pulling action fixedly joined to the traction posts and thereby to the first press yoke.

2. Radial press according to claim 1, in which the driver having a pulling action includes, connected with each traction post, a hydraulic jack.

3. Radial press according to claim 1, which includes hydraulic cylinders, and a case for hydraulic fluid and having a horizontal platform having opposite sides and in which the press axis (A) runs horizontally, the second press yoke is disposed on the platform, the hydraulic cylinders are disposed in the case for hydraulic fluid mounted beneath the platform for pulling the first press yoke toward the second press yoke and which includes means for mounting the second press yoke and the hydraulic cylinders on the opposite sides of the platform.

4. Radial press according to claim 3, in which the driver includes a hydraulic jack and piston and in which the first press yoke can be raised from the second press yoke by means of the hydraulic jack acting on the pistons for the purpose of a radial return of the press jaws.

5. Radial press according to claim 3, in which the platform is configured as a cover of the case for the hydraulic fluid.

6. Radial press according to claim 5, in which the platform has an opening and which includes a motor and a hydraulic pump, the pump reaching through the opening into the case and being driven by the motor, and the pump actuating the hydraulic cylinders.

7. Radial press according to claim 1, in which the outer can control bodies have each in its center a press jaw and on both sides thereof an inner can surface, adjacent ones of said inner cam surfaces bearing said plurality of inner cam follower bodies each with a press jaw, and said inner cam surfaces being at such an angle to the plane of symmetry of the outer cam control bodies that said inner cam follower bodies can be moved at the same radial velocity and over the same radial distance as the outer cam control bodies.

8. Radial press according to claim 1, which includes two traction posts and in which each of said press yokes has an approximately parallelepipedal envelope surface with a parallelepiped long axis and in which each of said yokes has two of said outer cam surfaces at right angles to one another, which are separated by a planar surface parallel to the parallelepiped's long axis, and bisectors of said two of said outer cam surfaces of each of said yokes running parallel to the drive direction, and which includes four of said outer cam control bodies and four of said inner cam follower bodies, which alternate; two of said outer cam control bodies lying above and below the press axis (A) and being supported motionless on said planar surfaces of the press yokes; the press yokes having additional planar boundary surfaces radially outside of the cam faces, which are parallel to one another and perpendicular to the driving direction, and bores in line with one another in pairs being provided for the two traction posts brought through said planar boundary surfaces.

9. Radial press according to claim 1, which includes guide plates placed on the press yokes ad inner cam follower bodies, the outer cam control bodies and the inner cam follower bodies being guided and held between the guide plates.

10. Radial press according to claim 1, in which said control bodies include uppermost and lowermost cam control bodies integral with corresponding ones of said press yokes.

* * * * *